US009650813B2

(12) United States Patent
Liu

(10) Patent No.: US 9,650,813 B2
(45) Date of Patent: May 16, 2017

(54) ANTI-THEFT CABLE AND ADAPTOR RING SETS

(71) Applicant: WEALLEYS TECHNOLOGIES CO., LTD., New Taipei (TW)

(72) Inventor: Li-Chen Liu, New Taipei (TW)

(73) Assignee: WEALLEYS TECHNOLOGIES CO., LTD., New Taipei (TW)

( * ) Notice: Subject to any disclaimer, the term of this patent is extended or adjusted under 35 U.S.C. 154(b) by 0 days.

(21) Appl. No.: 14/968,903

(22) Filed: Dec. 15, 2015

(65) Prior Publication Data

US 2017/0058569 A1 Mar. 2, 2017

(30) Foreign Application Priority Data

Aug. 27, 2015 (TW) ..... 104213942 U

(51) Int. Cl.

| | |
|---|---|
| ***E05B 67/00*** | (2006.01) |
| ***H01R 31/06*** | (2006.01) |
| ***E05B 67/06*** | (2006.01) |
| ***E05B 73/00*** | (2006.01) |

(52) U.S. Cl.

CPC ..... *E05B 67/003* (2013.01); *E05B 67/063* (2013.01); *E05B 73/0005* (2013.01); *H01R 31/06* (2013.01)

(58) Field of Classification Search

CPC ..... E05B 73/00; E05B 67/06; E05B 73/0005; E05B 73/0082; E05B 67/003; E05B 67/063; G08B 13/12; H01R 13/44; H01R 31/06; Y10T 70/5009

USPC ..... 70/14, 18, 19, 58, 457, 458, 30, 49; 340/568.2; 439/134

See application file for complete search history.

(56) References Cited

U.S. PATENT DOCUMENTS

| | | | | |
|---|---|---|---|---|
| 4,325,238 | A * | 4/1982 | Scherbing | E05B 67/003 70/18 |
| 4,570,465 | A * | 2/1986 | Bennett | E05B 73/0005 70/18 |
| 5,181,402 | A * | 1/1993 | Faessler | B65D 63/08 24/16 PB |
| 5,809,814 | A * | 9/1998 | Cons | A44B 15/00 40/330 |
| 5,896,762 | A * | 4/1999 | Iidaka | E05B 67/003 109/34 |
| 5,937,678 | A * | 8/1999 | Kuo | B62H 5/003 70/18 |
| 6,006,555 | A * | 12/1999 | Shu-Fen | E05B 67/003 70/18 |
| 6,026,664 | A * | 2/2000 | Lin | E05B 67/003 70/18 |
| 6,430,973 | B1 * | 8/2002 | Huang | B62H 5/003 70/18 |
| 6,477,870 | B1 * | 11/2002 | Derman | E05B 73/0005 70/18 |
| 6,622,532 | B2 * | 9/2003 | Hsu | E05B 73/0082 248/316.4 |

(Continued)

*Primary Examiner* — Suzanne Barrett

(74) *Attorney, Agent, or Firm* — Leong C. Lei

(57) ABSTRACT

The anti-theft cable and adaptor ring sets mainly contains a wire, at least an adaptor having a linking element threaded through by the wire, an end connector joining the wire's two ends and turning the wire into a ring, and a protection member housing the end connector. As such various types of adaptors are chained by the anti-theft wire so as to prevent them from being stolen.

3 Claims, 7 Drawing Sheets

(56) References Cited

U.S. PATENT DOCUMENTS

| | | | | |
|---|---|---|---|---|
| 6,763,688 | B1 * | 7/2004 | Syu | E05B 73/0082 248/553 |
| 6,923,027 | B1 * | 8/2005 | Kuo | E05B 67/003 70/233 |
| 7,131,298 | B1 * | 11/2006 | Haraughty | B62H 5/003 70/18 |
| 8,176,615 | B2 * | 5/2012 | Konecnik | E05B 73/0005 29/525.01 |
| 2004/0074264 | A1 * | 4/2004 | Kung | E05B 73/0082 70/58 |
| 2010/0313611 | A1 * | 12/2010 | Goulet | E05B 73/0005 70/58 |
| 2012/0064744 | A1 * | 3/2012 | Messner | H01R 13/44 439/133 |

* cited by examiner

ANTI-THEFT CABLE AND ADAPTOR RING SETS

BACKGROUND OF THE INVENTION (a) Technical Field of the Invention

The present invention is generally related to anti-theft devices, and more particular to an anti-theft wire protecting at least an adaptor.

(b) Description of the Prior Art

During exhibition, manufacturers usually provide demonstration products for customers to try. An anti-theft cable and adaptor ring sets is a common device to keep these demonstration products where they need to be as well as prevent them from being stolen. However, there are also adaptors available in the booth for the customers to test various types of connectivity. These adaptors are often left unnoticed and a large number of them are missing after the exhibition.

SUMMARY OF THE INVENTION

Therefore, a major objective of the present invention is to provide a novel anti-theft cable and adaptor ring sets where various types of adaptors are chained on a wire so as to prevent them from being stolen and keep them where they need to be.

To achieve the objective, the anti-theft cable and adaptor ring sets mainly contains a wire, at least an adaptor having a linking element threaded through by the wire, an end connector joining the wire's two ends and turning the wire into a ring, and a protection member housing the end connector.

The protection member has an openable body with a tubular channel.

Preferably, a flexible cushion set is provided around the tubular channel's inner wall.

Preferably, the wire is a security steel wire.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
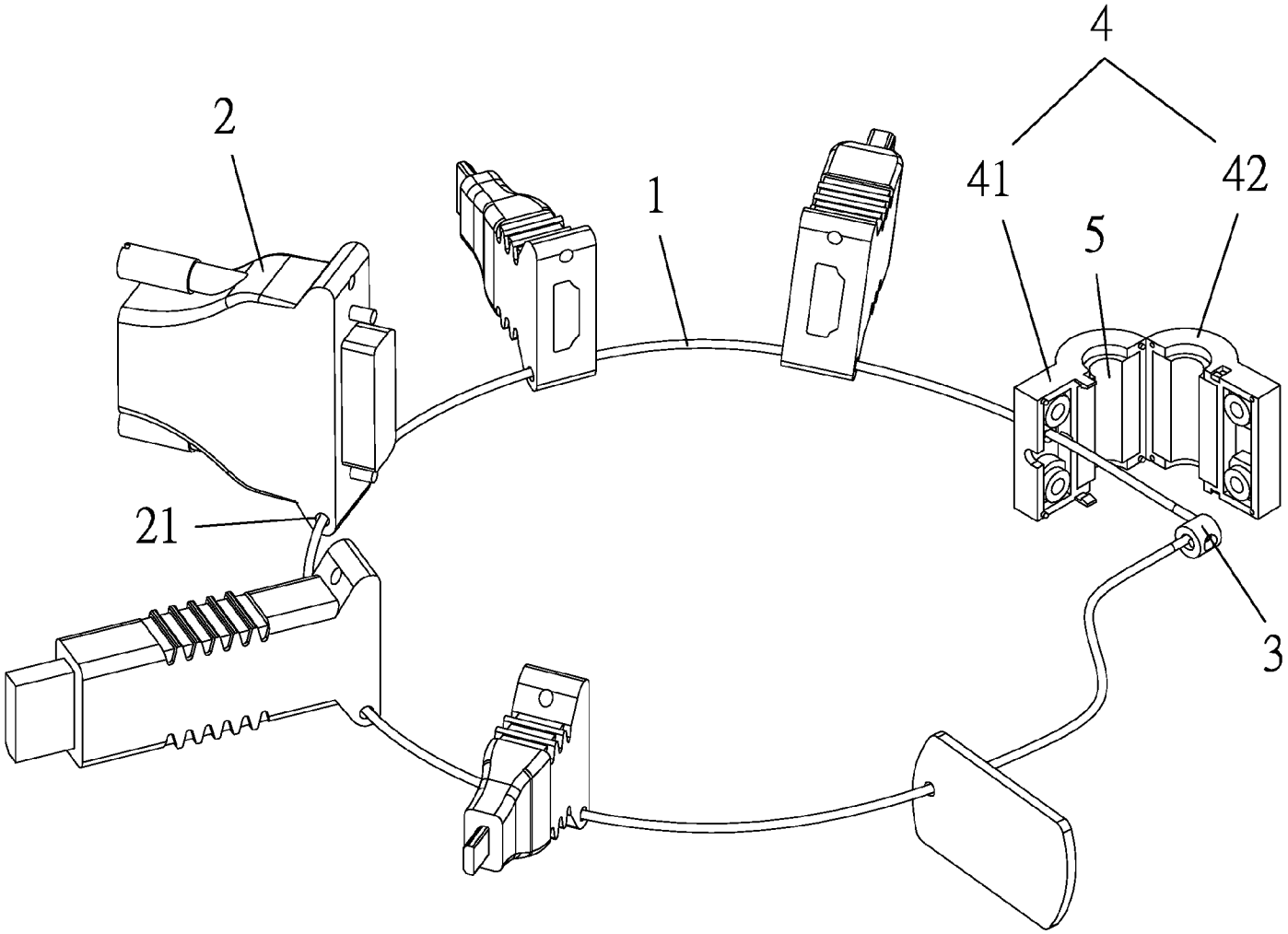
FIG. 1 is a perspective diagram showing an anti-theft cable and adaptor ring sets according to an embodiment of the present invention with a protection member opened.

As shown in FIG. 1, an anti-theft cable and adaptor ring sets according to an embodiment of the present invention contains a wire 1, at least an adaptor 2, an end connector 3, and a protection member 4. The adaptor 2 is configured with a linking element 21 threaded through by the wire 1 so that the adaptor 2 is attached to the wire 1. The end connector 3 joins the wire 1's two ends together so as to turn the wire 1 into a ring. The protection member 4 is also threaded through by the wire 1 and the end connector 3 is housed inside the protection member 4.

The protection member 4 has an openable body 41 with a tubular channel 42.

Preferably, a flexible cushion set 5 is configured around the tubular channel 42's inner wall. And the wire 1 is preferably a security steel wire.

Figure 2:
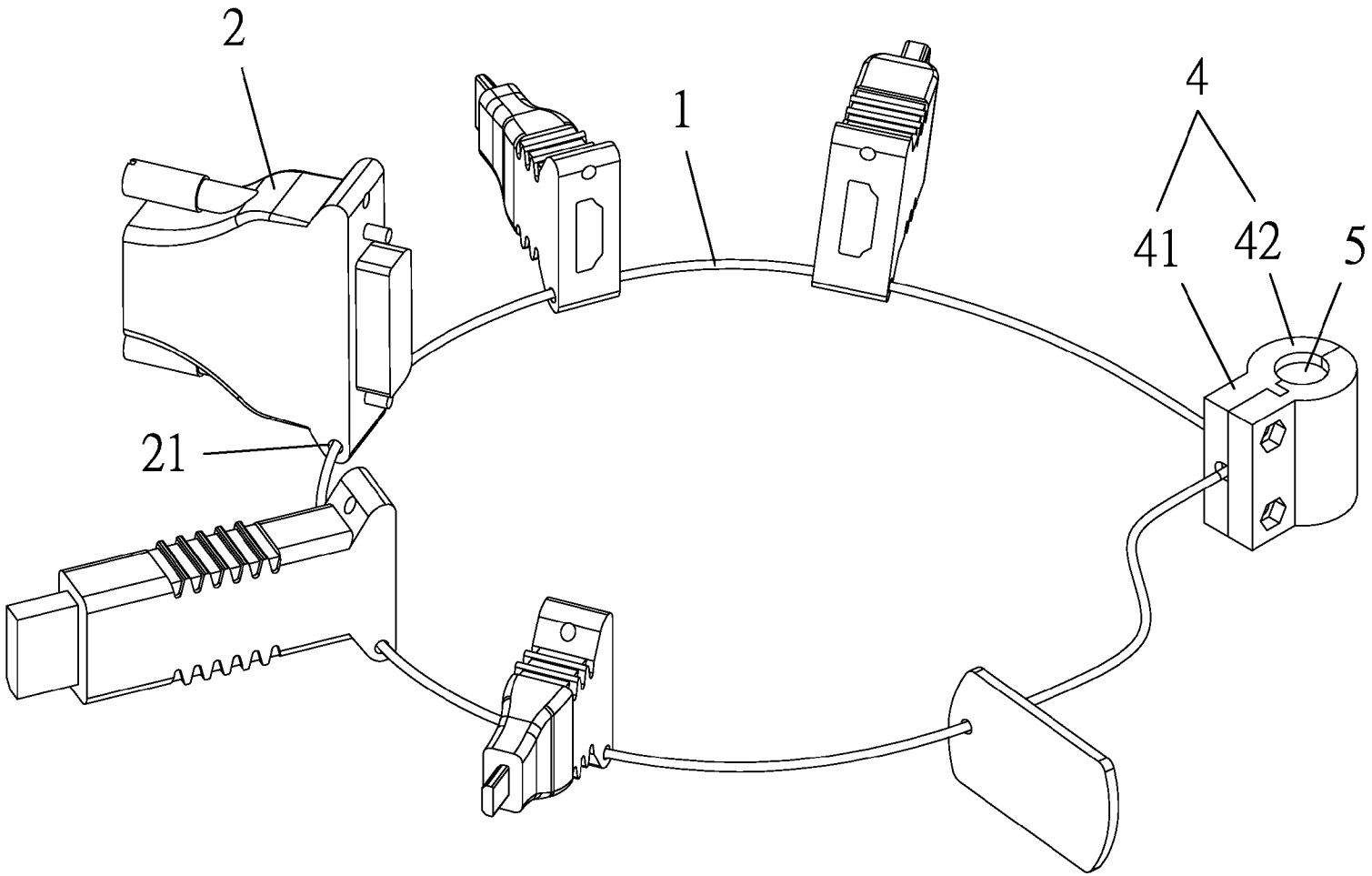
FIG. 2 is a perspective diagram showing the anti-theft cable and adaptor ring sets of FIG. 1 with the protection member closed.

As shown in FIG. 2, the end connector 3 is housed in the body 41 of the protection member 4 and the body 41 is closed to seal the end connector 3 so that the ring formed by the wire 1 is secured.

Figure 3:
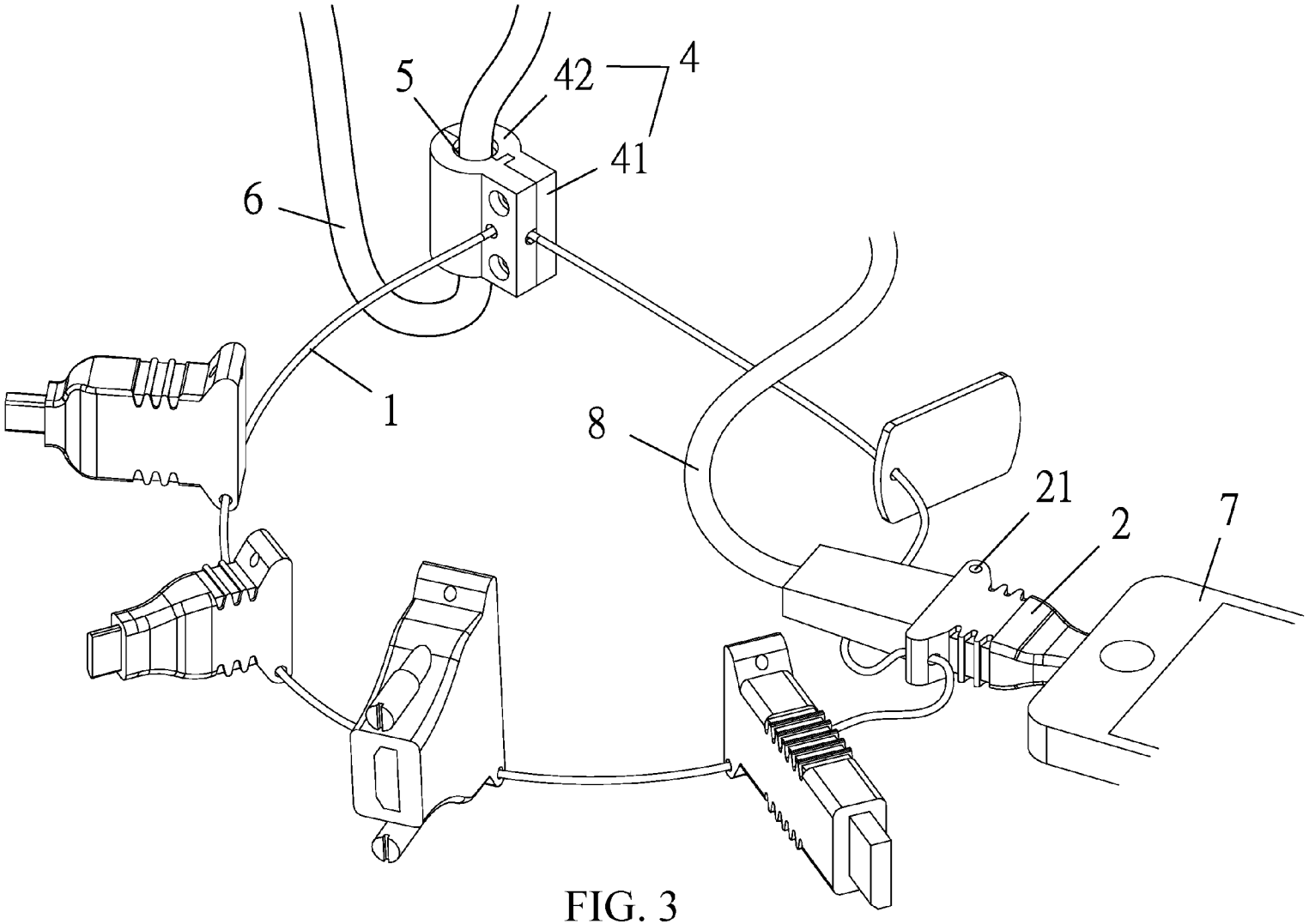
FIG. 3 is a perspective diagram showing an application scenario of the anti-theft cable and adaptor ring sets of FIG. 1.

As shown in FIG. 3, an additional cable 6 is threaded through the tubular channel 42 of the protection member 4, and the friction between the cable 6 and the tubular channel 42 is reduced by the flexible cushion 5. An adaptor 2 on the wire 1 is then connected to an appliance 7 and to a computer or a device (not shown) through a transmission cable 8 so as to test the appliance 7's connectivity to the computer or the device through the adaptor 2. As the adaptor 2 is reliably attached to the wire 1, it will not be stolen or taken away mistakenly.

Figure 4:
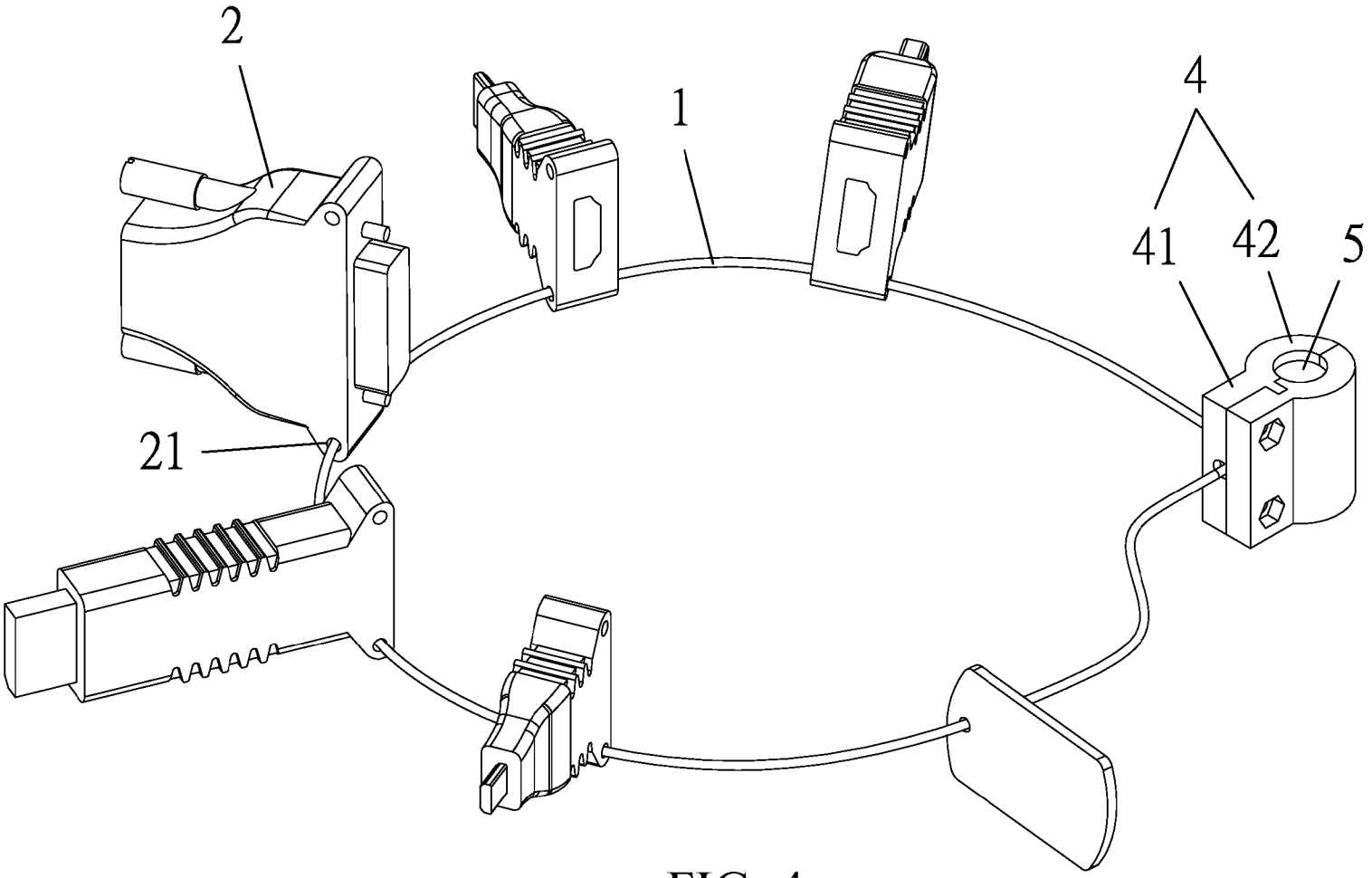
FIG. 4 is a perspective diagram showing an alternative embodiment of linking elements on the adaptors chained by the anti-theft cable and adaptor ring sets of FIG. 2.

As shown in FIGS. 2 and 4, there can be more than one linking element 21 on each adaptor 2 chained by the wire 1, and each linking element 21 is a through hole for the wire 1 to thread through. Each linking element 21 either runs in parallel along an edge of the adaptor 2 or runs perpendicularly through an edge of the adaptor 2.

Figure 5:
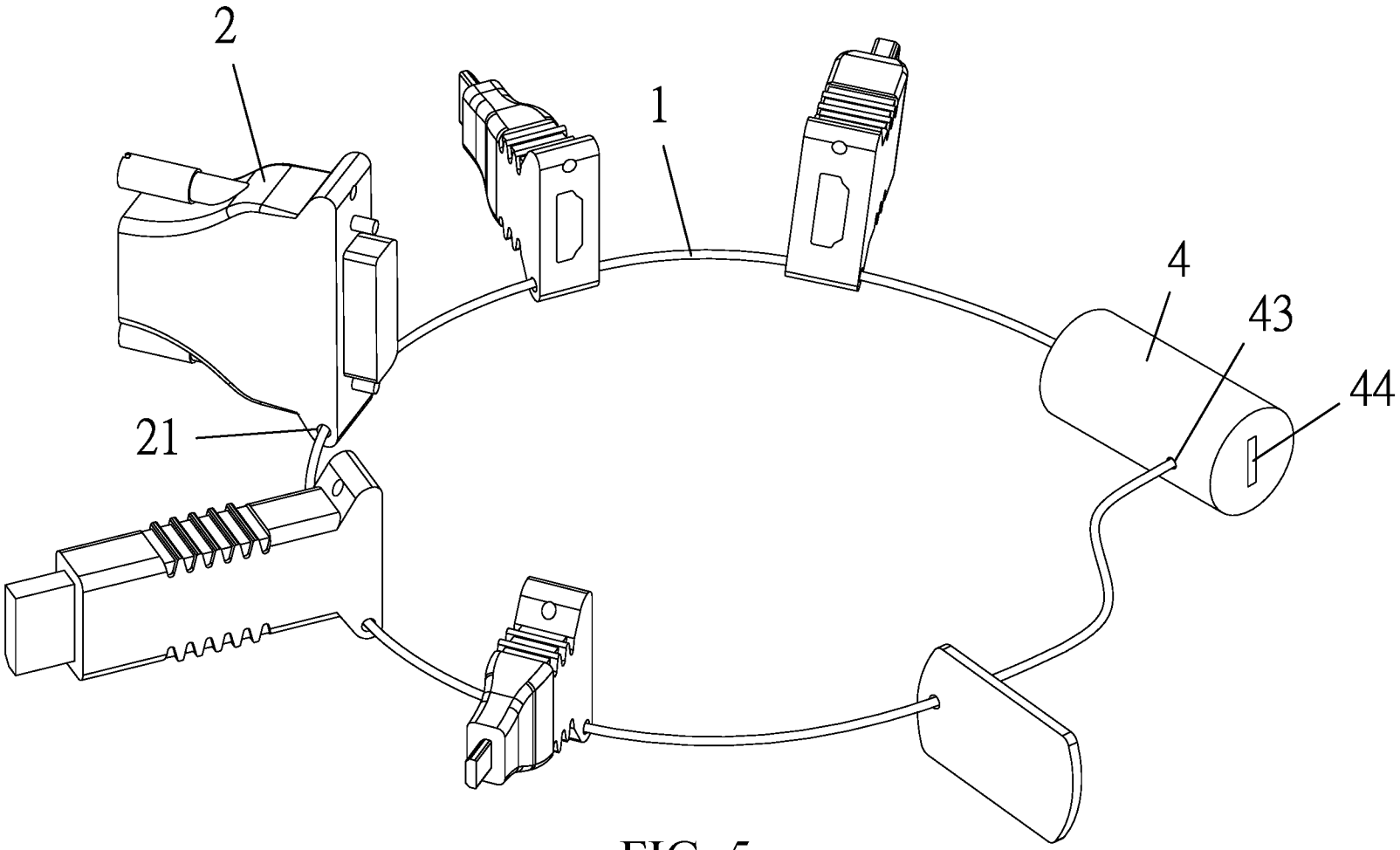
FIG. 5 is a perspective diagram showing an anti-theft cable and adaptor ring sets according to another embodiment of the present invention.

As shown in FIG. 5, according to another embodiment of the anti-theft cable and adaptor ring sets, the wire 1 has an end fixedly joined to a first end of the protection member 4 and has the other end running through a hole 43 on the protection member 4's circumference. The protection member 4 has an integral body having a locking slot 44 (usually called a K-slot or a Kensington lock) at a second end of the protection member 4 so as to protect the entire set of adaptors 2 on the wire 1.

Figure 6:
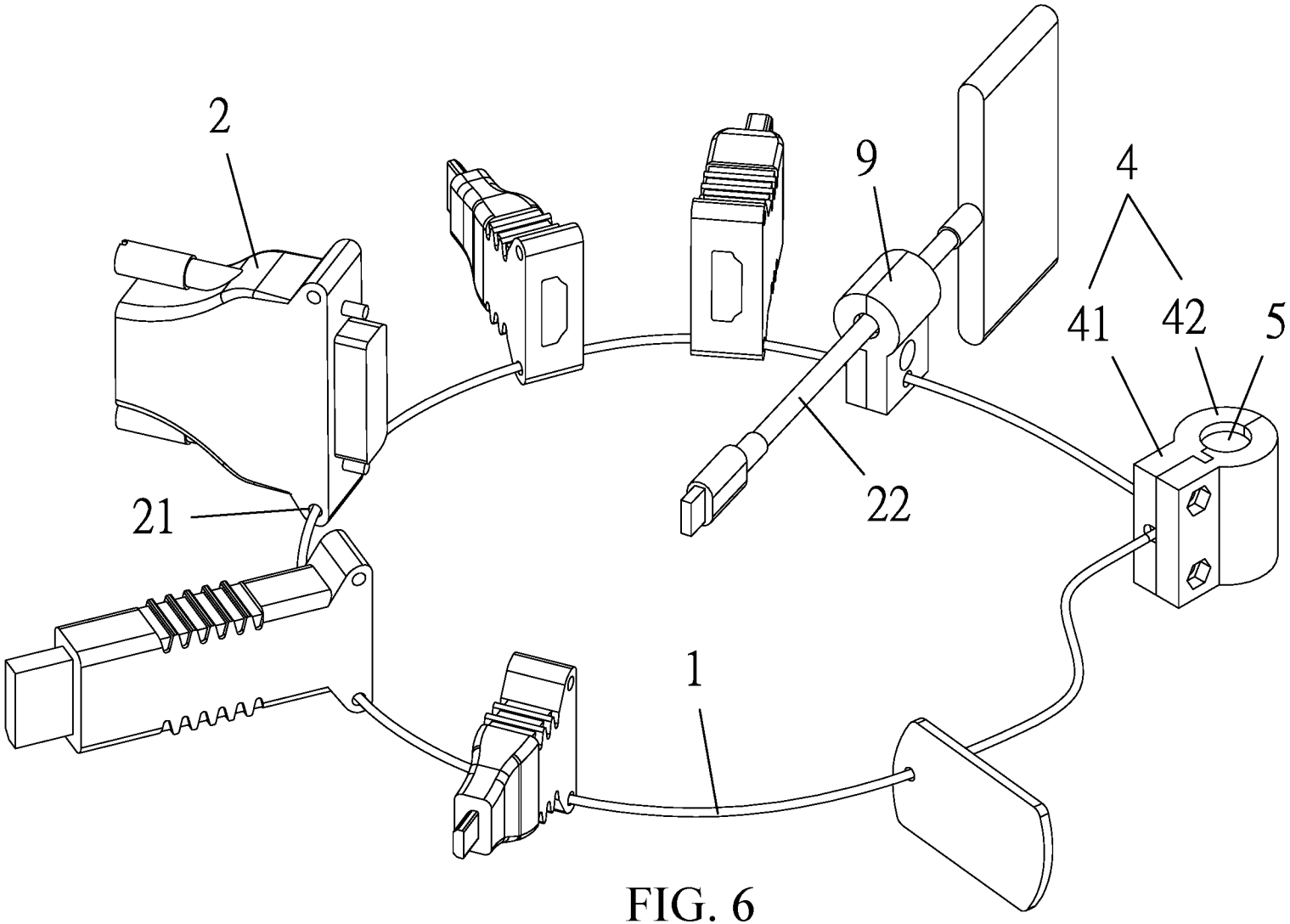
FIG. 6 is a perspective diagram showing an anti-theft cable and adaptor ring sets according to yet another embodiment of the present invention.

As shown in FIG. 6, according to yet another embodiment of the present invention, the anti-theft cable and adaptor ring sets further contains a connection member 9 also threaded through by the wire 1. The connection member 9 has separable body parts that, when joined together, a tubular channel (not numbered) is formed to clamp an adaptor cable 22 so as to secure the adaptor 2 and the adaptor cable 22.

Figure 7:
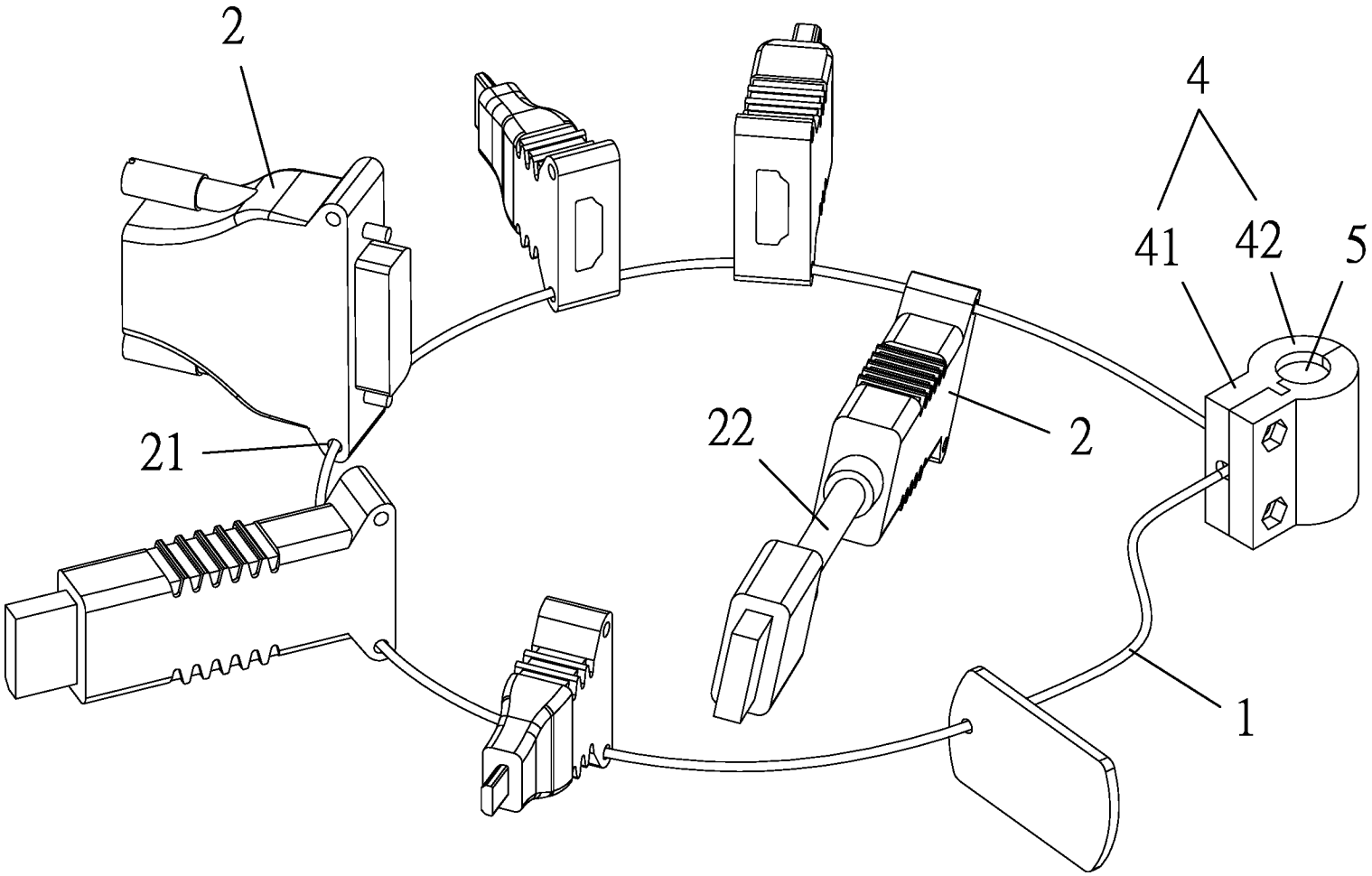
FIG. 7 is a perspective diagram showing another application scenario of the anti-theft cable and adaptor ring sets of FIG. 1.

For an adaptor cable 22 similar to the one shown in FIG. 6, the adaptor 2 and the adaptor cable 22 can also have a linking element 21 so as to be chained on the wire 1, as shown in FIG. 7.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An anti-theft cable and adaptor ring sets, comprising:

a wire;

at least an adaptor configured with a linking element threaded through by the wire;

a connection member threaded through by the wire, where the connection member has separable body parts that, when joined together, a first tubular channel is formed;

an end connector joining the wire's two ends together so as to turn the wire into a ring; and a protection member threaded through by the wire housing the end connector inside.

2. The anti-theft cable and adaptor ring sets according to claim 1, wherein the protection member has an openable body with a second tubular channel; and the end connector is sealed by the closed body.

3. The anti-theft cable and adaptor ring sets according to claim 2, wherein a flexible cushion set is configured around an inner wall of the tubular channel.

* * * * *